US008356428B2

(12) United States Patent
Auger et al.

(10) Patent No.: US 8,356,428 B2
(45) Date of Patent: Jan. 22, 2013

(54) ARTICLE OF FOOTWEAR WITH FLEXIBLE REINFORCING PLATE

(75) Inventors: Perry W. Auger, Tigard, OR (US); Sergio Cavaliere, Venice (IT)

(73) Assignee: Nike, Inc., Beaverton, OR (US)

( * ) Notice: Subject to any disclaimer, the term of this patent is extended or adjusted under 35 U.S.C. 154(b) by 581 days.

(21) Appl. No.: 12/582,252

(22) Filed: Oct. 20, 2009

(65) Prior Publication Data

US 2011/0088287 A1 Apr. 21, 2011

(51) Int. Cl.
*A43B 1/10* (2006.01)
*A43C 15/16* (2006.01)

(52) U.S. Cl. ..... 36/102; 36/59 R; 36/67 A

(58) Field of Classification Search ..... 36/102, 36/59 R, 67 A, 103, 67 D, 67 R, 126–128
See application file for complete search history.

(56) References Cited

U.S. PATENT DOCUMENTS

| | | | | |
|---|---|---|---|---|
| 2,070,269 | A | 2/1937 | Goldenberg | |
| 3,487,563 | A | 1/1970 | Austin | |
| 4,454,662 | A | 6/1984 | Stubblefield | |
| 4,546,559 | A | 10/1985 | Dassler | |
| 4,562,651 | A | 1/1986 | Frederick et al. | |
| 4,858,343 | A | 8/1989 | Flemming | |
| 5,024,007 | A | 6/1991 | DuFour | |
| 5,384,973 | A * | 1/1995 | Lyden | 36/25 R |
| 5,709,954 | A | 1/1998 | Lyden et al. | |
| 5,786,057 | A | 7/1998 | Lyden et al. | |
| 5,832,636 | A | 11/1998 | Lyden et al. | |
| 5,843,268 | A | 12/1998 | Lyden et al. | |
| 5,906,872 | A | 5/1999 | Lyden et al. | |
| 5,915,820 | A | 6/1999 | Kraeuter et al. | |
| 5,983,529 | A * | 11/1999 | Serna | 36/28 |
| 6,119,373 | A | 9/2000 | Gebhard et al. | |
| 6,199,303 | B1 | 3/2001 | Luthi et al. | |
| 6,438,873 | B1 | 8/2002 | Gebhard et al. | |
| 6,477,791 | B2 | 11/2002 | Luthi et al. | |
| 6,658,766 | B2 | 12/2003 | Kraeuter et al. | |
| 6,857,205 | B1 | 2/2005 | Fusco et al. | |
| 6,920,705 | B2 | 7/2005 | Lucas et al. | |
| 6,948,264 | B1 | 9/2005 | Lyden | |
| 6,954,998 | B1 * | 10/2005 | Lussier | 36/107 |
| 7,124,519 | B2 | 10/2006 | Issler | |
| 7,243,445 | B2 | 7/2007 | Manz et al. | |
| 7,650,707 | B2 * | 1/2010 | Campbell et al. | 36/127 |

(Continued)

FOREIGN PATENT DOCUMENTS

| | | |
|---|---|---|
| DE | 2927635 | 1/1981 |

(Continued)

OTHER PUBLICATIONS

International Preliminary Report on Patentability (including Written Opinion of the ISA) mailed May 3, 2012 in International Application No. PCT/US2010/053340.

(Continued)

*Primary Examiner* — Ted Kavanaugh
(74) *Attorney, Agent, or Firm* — Plumsea Law Group, LLC

(57) ABSTRACT

A sole structure for an article of footwear is disclosed. The sole structure includes a reinforcing plate. The reinforcing plate includes a first flange portion corresponding to a big toe of a foot and a second flange portion corresponding to a ball region of a foot. The first flange portion and the second flange portion each include a cleat member.

20 Claims, 11 Drawing Sheets

U.S. PATENT DOCUMENTS

| | | | | |
|---|---|---|---|---|
| 7,707,748 | B2 * | 5/2010 | Campbell | 36/102 |
| 7,818,897 | B2 | 10/2010 | Geer | |
| 2001/0005947 | A1 | 7/2001 | Sordi | |
| 2002/0062578 | A1 | 5/2002 | Lussier et al. | |
| 2005/0016029 | A1 | 1/2005 | Auger et al. | |
| 2006/0021255 | A1 | 2/2006 | Auger et al. | |
| 2007/0199211 | A1 * | 8/2007 | Campbell | 36/59 R |
| 2007/0199213 | A1 * | 8/2007 | Campbell et al. | 36/102 |
| 2008/0010863 | A1 | 1/2008 | Auger et al. | |
| 2008/0072457 | A1 | 3/2008 | Shakoor et al. | |
| 2008/0216352 | A1 | 9/2008 | Baucom et al. | |
| 2009/0056169 | A1 * | 3/2009 | Robinson et al. | 36/102 |
| 2009/0249648 | A1 | 10/2009 | Brown et al. | |
| 2009/0313856 | A1 | 12/2009 | Arizumi | |
| 2010/0005684 | A1 | 1/2010 | Nishiwaki et al. | |
| 2010/0050475 | A1 | 3/2010 | Benz | |
| 2010/0083539 | A1 | 4/2010 | Norton | |
| 2011/0146110 | A1 | 6/2011 | Geer | |

FOREIGN PATENT DOCUMENTS

| | | |
|---|---|---|
| DE | 3703932 | 8/1988 |
| DE | 3706069 | 9/1988 |
| DE | 102008033241 | 11/2009 |
| EP | 0723745 | 7/1996 |
| EP | 0890321 | 1/1999 |
| EP | 965281 | 12/1999 |
| EP | 1106093 | 6/2001 |
| EP | 1234516 | 8/2002 |
| EP | 1369049 | 12/2003 |
| EP | 2014186 | 1/2009 |
| EP | 2286684 | 2/2011 |
| EP | 2305056 | 4/2011 |
| EP | 2319342 | 5/2011 |
| FR | 2608387 | 6/1988 |
| FR | 2775875 | 9/1999 |
| GB | 2340378 | 2/2000 |
| GB | 2425706 | 7/2005 |
| JP | 8214910 | 8/1996 |
| JP | 2000236906 | 9/2000 |
| JP | 2002142802 | 5/2002 |
| JP | 2002306207 | 10/2002 |
| JP | 2003284605 | 10/2003 |
| JP | 2006198101 | 8/2006 |
| WO | 9807341 | 2/1998 |
| WO | 9820763 | 5/1998 |
| WO | 03071893 | 9/2003 |
| WO | 2007138947 | 12/2007 |

OTHER PUBLICATIONS

Wiki(Boot)Leaks: adiZero II & adipure11Pro-More Info!, dated Jun. 22, 2011, accessed Aug. 25, 2011. http://www.soccerreviews.com.

Invitation to Pay Additional Fees mailed May 4, 2011 in International Application No. PCT/US2010/053340.

International Search Report and Written Opinion mailed Aug. 12, 2011 in International Application No. PCT/US2010/053340.

International Search Report and Written Opinion mailed Jun. 13, 2012 in International Application No. PCT/US2012/021663.

* cited by examiner

ARTICLE OF FOOTWEAR WITH FLEXIBLE REINFORCING PLATE

BACKGROUND

The present invention relates generally to an article of footwear, and in particular to an article of footwear with a sole structure having a flexible reinforcing plate.

Articles of footwear with flexible sole structures have been previously proposed. Austin (U.S. Pat. No. 3,487,563) teaches a sole provided with transverse grooves to provide lines of flexing remote from the studs projecting from the sole. Specifically, Austin teaches a molded sole of rubber or synthetic plastic materials. Studs project from the sole and grooves are provided during molding of the sole to provide lines of easy flexing in the sole.

DuFour (U.S. Pat. No. 5,024,007) teaches a walking sole for a golf shoe. DuFour teaches a sole having a main element of rigid molded plastic with notches that include an elastic material. DuFour teaches that the notches delimit tongues formed in the sole. DuFour also teaches that studs may be fastened to the flexible tongues.

The related art lacks provisions for accommodating flexing of various features of a foot. There is a need for articles that address the limitations of the related art.

SUMMARY

In one aspect, the invention provides a sole structure for an article of footwear, comprising: a reinforcing plate; the reinforcing plate including a flange portion, the flange portion having a first end portion connected to a central portion of the reinforcing plate and a second end portion extending to an outer peripheral portion of the reinforcing plate; a cleat member associated with the first flange portion; and wherein the flange portion corresponds to a big toe of a foot and wherein the flange portion is capable of bending with the big toe.

In one aspect, the invention provides a sole structure for an article of footwear, comprising: a reinforcing plate; the reinforcing plate including a flange portion, the flange portion having a first end portion connected to a central portion of the reinforcing plate and a second end portion extending to an outer peripheral portion of the reinforcing plate; the flange portion being disposed between a first flex groove and a second flex groove; a first end of the first flex groove being disposed adjacent to the first end portion of the flange portion and a second end of the second flex groove being disposed adjacent to the first end portion of the flange portion; a bending region of the flange portion extending between the first end of the first flex groove and the second end of the second flex groove, the flange portion being configured to bend with respect to the reinforcing plate at the bending region; a normal bending axis extending perpendicularly from the bending region through the flange portion; a cleat member associated with the flange portion; and wherein the cleat member is spaced apart from the normal bending axis.

In one aspect, the invention provides A sole structure for an article of footwear, comprising: a reinforcing plate; a plurality of flex grooves disposed in a forefoot portion of the reinforcing plate; the plurality of flex grooves extending from a central portion of the reinforcing plate to an outer peripheral portion of the reinforcing plate; the plurality of flex grooves forming a first flange portion and a second flange portion; the first flange portion being associated with a first cleat member and the second flange portion being associated with a second cleat member; and where each flex groove of the plurality of flex grooves extends in an approximately radial direction from the central portion.

In one aspect, the invention provides an article of footwear, comprising: a sole structure including a reinforcing plate; the reinforcing plate further including at least one flex groove; a lasting board including at least one flex groove; and where the at least one flex groove of the lasting board is arranged in a substantially similar configuration to the at least one flex groove of the reinforcing plate.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
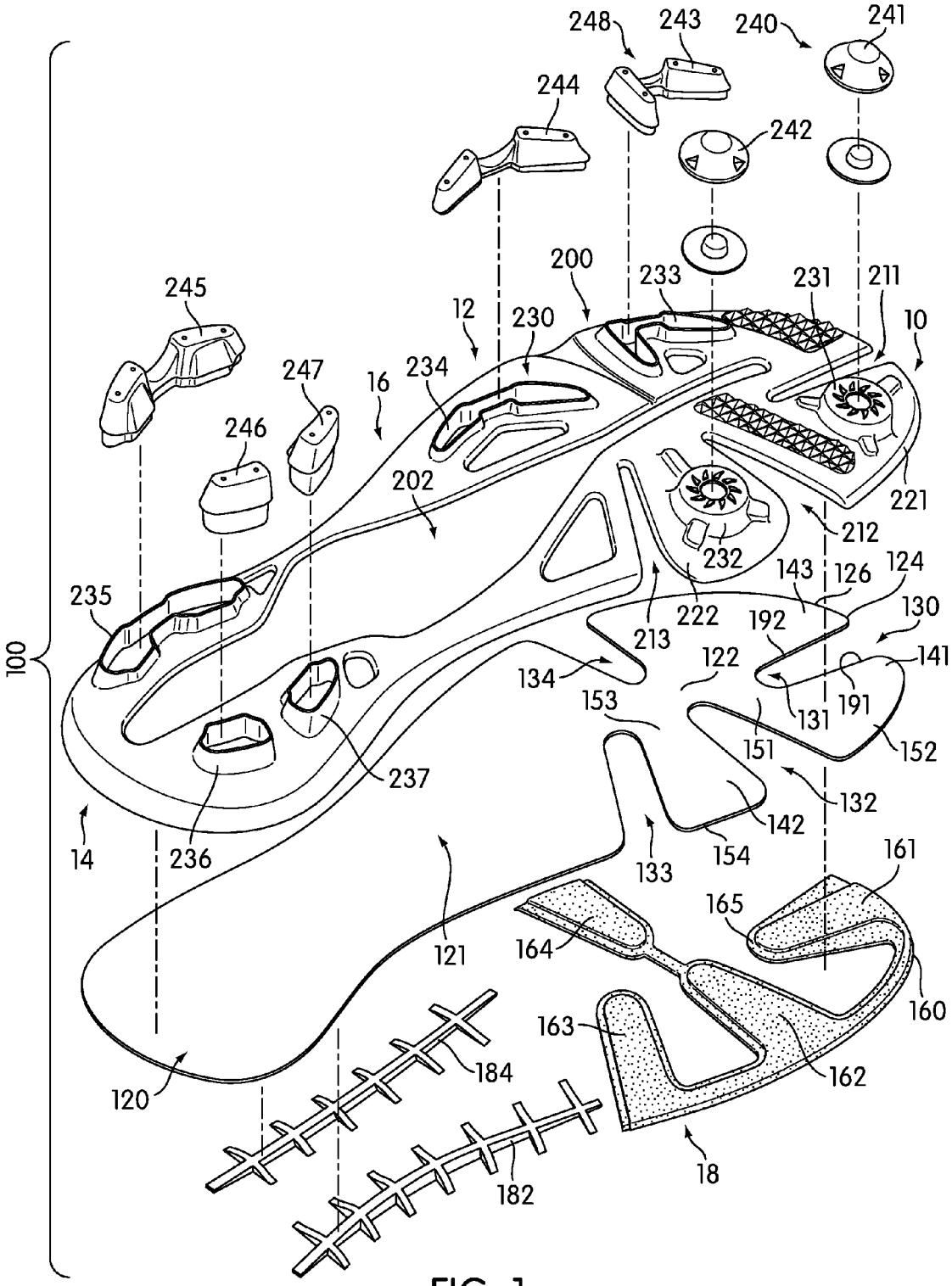
FIG. 1 is an isometric exploded view of an embodiment of a sole structure for an article of footwear.
Figure 2:
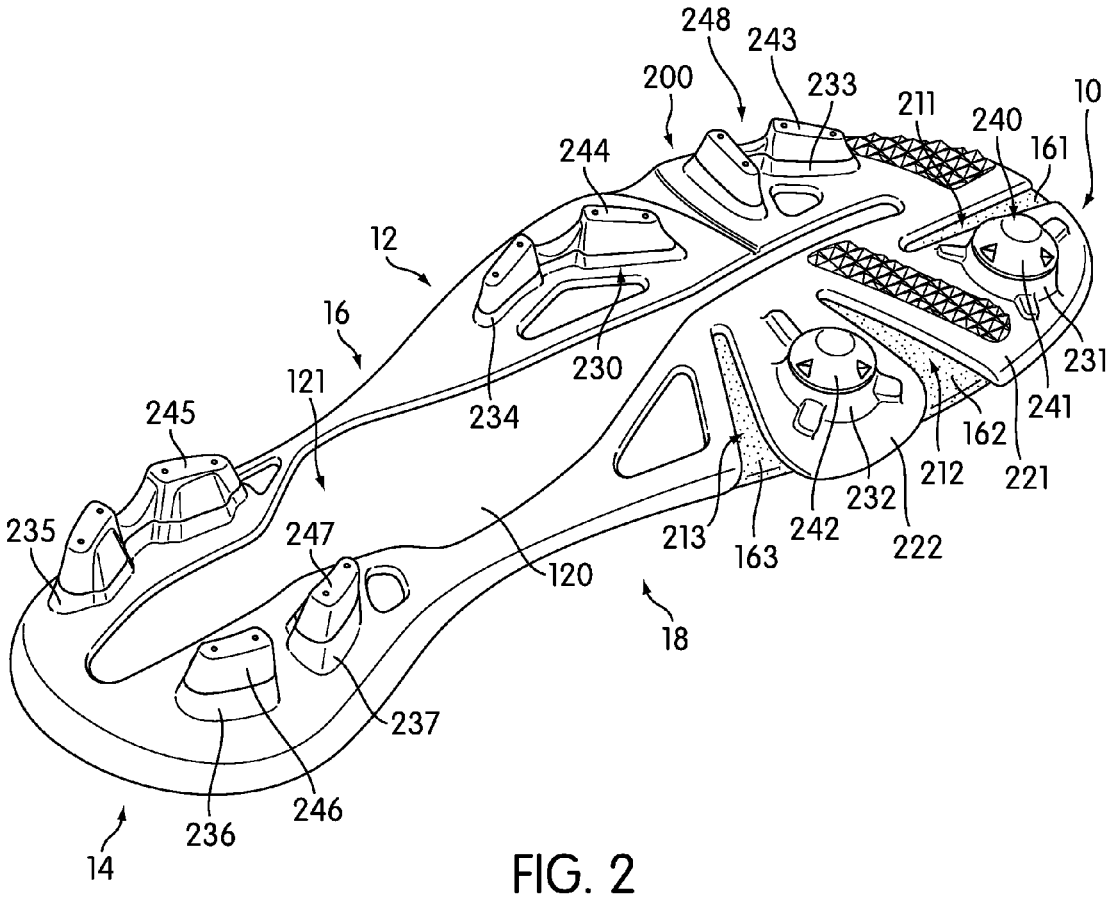
FIG. 2 is an isometric assembled view of an embodiment of a sole structure for an article of footwear.

FIGS. 1 and 2 illustrate views of an exemplary embodiment of sole structure 100 for an article of footwear. For purposes of illustration, sole structure 100 is shown in isolation in the current embodiment. In other embodiments, however, sole structure 100 could be associated with an upper for an article of footwear. For clarity, the following detailed description discusses an exemplary embodiment, in the form of a sole structure for a sports shoe, but it should be noted that the present invention could take the form of a sole structure for any article of footwear including, but not limited to: hiking boots, soccer shoes, football shoes, sneakers, rugby shoes, basketball shoes, baseball shoes as well as other kinds of shoes. As shown in FIGS. 1 and 2, sole structure 100, also referred to simply as sole 100, is intended to be used with a right foot; however, it should be understood that the following discussion may equally apply to a mirror image of sole structure 100 that is intended for use with a left foot.

Referring to FIGS. 1 and 2, for purposes of reference, sole 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, sole structure 100 may include lateral side 16 and medial side 18. In particular, lateral side 16 and medial side 18 may be opposing sides of sole structure 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of sole structure 100. Likewise, lateral side 16 and medial side 18 are intended to represent generally two sides of an article, rather than precisely demarcating sole structure 100 into two halves. In addition, forefoot portion 10, midfoot portion 12 and heel portion 14, as well as lateral side 16 and medial side 18, can also be applied to individual components of a sole structure.

For consistency and convenience, directional adjectives are employed throughout this detailed description corresponding to the illustrated embodiments. The term "longitudinal" as used throughout this detailed description and in the claims refers to a direction extending a length of a sole structure. In some cases, the longitudinal direction may extend from a forefoot portion to a heel portion of the sole. Also, the term "lateral" as used throughout this detailed description and in the claims refers to a direction extending a width of a sole. In other words, the lateral direction may extend between a medial side and a lateral side of a sole. Furthermore, the term "vertical" as used throughout this detailed description and in the claims refers to a direction generally perpendicular to a lateral and longitudinal direction. For example, in cases where a sole is planted flat on a ground surface, the vertical direction may extend from the ground surface upward. It will be understood that each of these directional adjectives may be applied to individual components of a sole.

In some embodiments, sole structure 100 may be configured to provide traction for an article of footwear. In addition to providing traction, sole structure 100 may attenuate ground reaction forces when compressed between the foot and the ground during walking, running or other ambulatory activities. The configuration of sole structure 100 may vary significantly in different embodiments to include a variety of conventional or non-conventional structures. In some cases, the configuration of sole structure 100 can be configured according to one or more types of ground surfaces on which sole structure 100 may be used. Examples of ground surfaces include, but are not limited to: natural turf, synthetic turf, dirt, as well as other surfaces.

In different embodiments, sole structure 100 may include different components. For example, sole structure 100 may include an outsole, a midsole, and/or an insole. In some cases, one or more of these components may be optional.

Sole structure 100 can include reinforcing plate 120. The term "reinforcing plate" as used throughout this detailed description and in the claims refers to any layer that provides substantial strength and support for sole structure 100. A reinforcing plate can be made from any material or combination of materials. In some cases, a reinforcing plate could be made of a composite material such as carbon fiber reinforced polymer. In other cases, another fiber reinforced polymer could be used. In still other cases, a metallic material could be used. In an exemplary embodiment, a material may be used that has a high strength to weight ratio.

Reinforcing plate 120 may include provisions for enhancing the flexibility of sole structure 100. In some embodiments, reinforcing plate 120 may be provided with one or more flex grooves. In the current embodiment, reinforcing plate 120 may comprise plurality of flex grooves 130. In particular, plurality of flex grooves 130 may comprise first flex groove 131, second flex groove 132, third flex groove 133 and fourth flex groove 134 that are disposed in forefoot portion 10 of reinforcing plate 120.

Although four flex grooves are shown in the current embodiment, in other embodiments, reinforcing plate 120 may have any other number of flex grooves. In some cases, reinforcing plate 120 could include a single flex groove. In other cases, reinforcing plate 120 could include two or three flex grooves. In still other cases, reinforcing plate could include more than four flex grooves. Furthermore, although the current embodiment includes flex grooves disposed in forefoot portion 10 of reinforcing plate 120, in other embodiments flex grooves could be disposed in other portions of reinforcing plate 120. For example, in other embodiments flex grooves could be disposed in midfoot portion 12 and/or heel portion 14.

Generally, each flex groove of plurality of flex grooves 130 may extend from central portion 122 of reinforcing plate 120. For example, first flex groove 131 extends from central portion 122 to outer peripheral portion 124 of reinforcing plate 120. In a similar manner, each flex groove of plurality of flex groves 130 may extend from central portion 122 to outer peripheral portion 124 of reinforcing plate.

In an exemplary embodiment, each flex groove of plurality of flex grooves 130 may be oriented in a substantially different direction. For example, first flex grove 131 may extend in an approximately radial direction from central portion 122 of reinforcing plate 120 to forward edge 126 of reinforcing plate 120. In some cases, first flex groove 131 may be oriented in an approximately longitudinal direction. Additionally, second flex groove 132 may extend in an approximately radial direction from central portion 122 of reinforcing plate 120 to medial side 18 of outer peripheral portion 124. In some cases, second flex groove 132 may be oriented in an approximately lateral direction. Third flex groove 133 may also extend in an approximately radial direction from central portion 122 of reinforcing plate 120 towards medial side 18 of outer peripheral portion 124. However, the orientation of third flex groove 133 may be angled with respect to second flex groove 132. In addition, fourth flex groove 134 may extend in an approximately radial direction from central portion 122 of reinforcing plate 120 to lateral side 16 of outer peripheral portion 124. This arrangement may provide a substantially radial configuration for plurality of flex grooves 130 which can facilitate omni-directional flexing for adjacent portions of forefoot portion 10 of reinforcing plate 120. It will be understood that in other embodiments, plurality of flex grooves 130 could be arranged in any other configuration on forefoot portion 10 of reinforcing plate 120.

In different embodiments, the shapes of one or more flex grooves could vary. In some cases, one or more flex grooves could have an approximately linear shape. In other cases, one or more flex grooves could have a non-linear shape. Furthermore, in some cases, the width of one or more flex grooves could vary. In other cases, each flex groove could be provided with a substantially constant width. In an exemplary embodiment, each flex groove of plurality of flex grooves 130 may have variable widths that increase from central portion 122 to outer peripheral portion 124 of reinforcing plate 120. This widening flex groove arrangement may provide enhanced flexing for portions of reinforcing plate 120.

In some embodiments, flex grooves can form flange portions in reinforcing plate 120. For example, in the current embodiment, first flex groove 131 and second flex groove 132 may form first flange portion 141. Similarly, second flex groove 132 and third flex groove 133 may form second flange portion 142. Also, in some cases, first flex groove 131 and fourth flex groove 134 may form widened flange portion 143 on lateral side 16 of reinforcing plate 120.

Generally, the shapes of each flange portion can vary to accommodate bending in different regions of a foot. First flange portion 141 may include first end portion 151 that is connected to central portion 122 and second end portion 152 that extends to outer peripheral portion 124. First flange portion 141 is generally narrower at first end portion 151 and widens towards second end portion 152. Likewise second flange portion 142 may include first end portion 153 that is connected to central portion 122 and second end portion 154 that extends to outer peripheral portion 124. Second flange portion 142 is generally narrower at first end portion 153 and widens towards second en portion 154. Furthermore, in the current embodiment, second flange portion 142 has a symmetric shape about a central axis through the length of second flange portion 142. In contrast, first flange portion 141 has a substantially asymmetric shape. In addition, third flange portion 143 has an approximately symmetric shape that widens from central portion 122 to outer peripheral portion 124.

In some embodiments, one or more flange portions can be configured to provide support for different parts of a foot. In one embodiment, first flange portion 141 may correspond to a big toe of a foot. In particular, first flange portion 141 may be provided at a location of reinforcing plate 120 disposed beneath a big toe when an article of footwear incorporating sole structure 100 is worn. Also, first flange portion 141 may have a shape that is approximately similar to the shape of a big toe.

In some cases, first flex groove 131 and second flex groove 132 can enhance the correspondence between first flange portion 141 and the big toe of a foot. In some embodiments, for example, first flex groove 131 may be disposed below a gap between a big toe and an index toe. Additionally, in some embodiments, second flex groove 132 can be disposed beneath an interphalangeal joint of the big toe. This configuration helps provide a toe like arrangement for first flange portion 141. Furthermore, this arrangement can help first flange portion 141 to articulate in a manner that is similar to the articulation of the big toe, since first flange portion 141 may bend at second flex groove 132 and is separated from reinforcing plate 120 at first flex groove 131.

In some cases, second flange portion 142 may correspond to the ball region of a foot. In particular, second flange portion 142 may be provided at a location of reinforcing plate 120 disposed beneath the ball region of a foot when an article of footwear incorporating sole structure 100 is worn. In some embodiments, third flange portion 143 may also correspond to a plurality of toes including, for example, the index toe, the third toe, the fourth toe and the fifth toe. In particular, third flange portion 143 may be disposed beneath a plurality of toes when an article of footwear incorporating sole structure 100 is worn on a foot. These configurations for first flange portion 141, second flange portion 142 and third flange portion 143 provide reinforcing plate 120 with the ability to bend at predetermined portions corresponding to the toes as well as the ball of a foot.

In some embodiments, a sole structure can include provisions for filling in one or more flex grooves. For example, in some cases, a flex groove could be filled with a partially elastic material that enhances support and does not substantially interfere with flexing along the flex groove. In addition, in some cases, flex grooves could be filled with a material to improve the aesthetic appearance of a reinforcing plate.

Sole structure 100 can include filling member 160. In some cases, filling member 160 can comprise a plurality of filling portions that are configured to fill in a plurality of flex grooves. In the current embodiment, filling member 160 comprises first filling portion 161, second filling portion 162, third filling portion 163 and fourth filling portion 164 that are configured to fill first flex groove 131, second flex groove 132, third flex groove 133 and fourth flex groove 134 of reinforcing plate 120. In particular, first filing portion 161, second filing portion 162, third filing portion 163 and fourth filling portion 164 have approximately similar sizes and shapes to first flex groove 131, second flex groove 132, third flex groove 133 and fourth flex groove 134. For example, in the current embodiment first filling portion 161 extends from first edge 191 of first flex groove 131 to second edge 192 of first flex groove 131. In a similar manner, each of the remaining filling portions may extend across the edges of a corresponding flex groove. Therefore, as one or more of plurality of flex grooves 130 widens to accommodate flexing in reinforcing plate 120, one or more filling portions of filling member 160 could stretch or otherwise deform to accommodate this flexing.

In some embodiments, filling portions can be joined to one another. For example, in the current embodiment, first filling portion 161, second filling portion 162, third filling portion 163 and fourth filling portion 164 comprise a single filling member 160. However, in other embodiments, filling portions can be separated from one another. For example, in another embodiment, first filling portion 161, second filling portion 162, third filling portion 163 and fourth filling portion 164 could be individual portions that are not connected to one another.

In an exemplary embodiment, first filling portion 161, second filling portion 162, third filling portion 163 and fourth filling portion 164 may be bonded or otherwise attached to reinforcing plate 120 in a manner that disposes each filling portion in a corresponding flex groove. Generally, any method known in the art for bonding different materials together may be used. In one embodiment, inner peripheral edges 165 of each filling portion of filling member 160 could be bonded to the edges of plurality of flex grooves 130. It will be understood that while the current embodiment comprises a plurality of filling portions joined together into a single filling member, other embodiments could include disjoint filling portions.

In some embodiments, filling member 160 may comprise a substantially elastic material. For example, in one embodiment, filling member 160 may comprise a material having a first elasticity that is greater than a second elasticity of reinforcing plate 120. With this arrangement, first filling portion 161, second filling portion 162, third filling portion 163 and fourth filling portion 164 may be configured to accommodate flexing at first flex groove 131, second flex groove 132, third flex groove 133 and fourth flex groove 134, respectively. In an exemplary embodiment, for example, filling member 160 could comprise a polymer material such as thermoplastic polyurethane (TPU). It will be understood that the amount of flexibility provided by each flex groove can be varied by adjusting the elasticity of the corresponding filling portions. Furthermore, although the present embodiment includes filling portions having a substantially similar elasticity, in other embodiments different filling portions could have different elasticities to achieve different amounts of flexing in each flex groove of plurality of flex grooves 130.

In some embodiments, sole structure 100 can be provided with provisions for providing additional support throughout midfoot portion 12 and heel portion 14. In some cases, one or more support ribs can be applied to an upper surface of reinforcing plate 120. In the current embodiment, for example, first support rib 182 and second support rib 184 can be provided on medial side 18 and lateral side 16, respectively, of reinforcing plate 120. In this case, first support rib 182 and second support rib 184 can extend through midfoot portion 12 and heel portion 14 to help increase rigidity in these regions of sole structure 100.

A sole structure can include provisions for mounting one or more cleat members to a reinforcing plate. In some cases, a sole structure can include an outer member for mounting cleat members that can be bonded or otherwise attached to a reinforcing plate. In addition, in some cases, an outer member can be provided to cover portions of a reinforcing plate and act as a ground contacting surface for the sole structure.

Sole structure 100 can include outer member 200. Outer member 200 may comprise a substantially rigid ground contacting member that is attached to lower surface 121 of reinforcing plate 120. In some embodiments, outer member 200 may have a substantially similar shape to reinforcing plate 120. In the exemplary embodiment, outer member 200 is provided with central hole 202 that exposes a portion of reinforcing plate 120 on a lower surface of sole structure 100. In other embodiments, however, outer member 200 could comprise a substantially continuous lower surface for a sole structure without any holes.

Forefoot portion 10 of outer member 200 may comprise flex grooves that correspond to the flex grooves of reinforcing plate 120. In some cases, outer member 200 can include first outer flex groove 211, second outer flex groove 212 and third outer flex groove 213 that correspond to first flex groove 131, second flex groove 132 and third flex groove 133 of reinforcing plate 120. In some cases, each outer flex groove may be substantially similar in size and shape to a corresponding flex groove on reinforcing plate 120. In other cases, each flex grove could have a substantially different size and/or shape than a corresponding flex groove on reinforcing plate 120. For example, in the current embodiment, first outer flex groove 211, second outer flex groove 212 and third outer flex groove 213 may have substantially narrower widths than first flex groove 131, second flex groove 132 and third flex groove 133, respectively. Although the current embodiment only includes three outer flex grooves on outer member 200, in other embodiments any other number of outer flex grooves could be provided on outer member 200. For example, in another embodiment, outer member 200 could include a fourth outer flex groove that corresponds to fourth flex groove 134 of reinforcing plate 120. By providing outer member 200 with outer flex grooves that correspond to plurality of flex grooves 130, the flexibility of forefoot portion 10 can be increased in a manner that accommodates the flexibility of reinforcing plate 120.

In some embodiments, outer member 200 can include first flange covering portion 221 and second flange covering portion 222 that are configured to cover first flange portion 141 and second flange portion 142. In particular, first flange covering portion 221 is a flange-like portion of outer member 200 formed by first outer flex groove 211 and second outer flex groove 212. Additionally, second flange covering portion 222 is a flange-like portion of outer member 200 formed by second outer flex groove 212 and third outer flex groove 213. In some cases, first flange covering portion 221 may have a substantially similar shape to first flange portion 141 and second flange covering portion 222 may have a substantially similar shape to second flange portion 142. With this arrangement, first flange covering portion 221 and second flange covering portion 222 may provide coverings for first flange portion 141 and second flange portion 142 that do not substantially interfere with the flexibility of first flange portion 141 and second flange portion 142.

Outer member 200 can include provisions for mounting one or more cleat members to sole structure 100. The term "cleat member" as used throughout this detailed description and in the claims includes any provisions disposed on a sole for increasing traction through friction or penetration of a ground surface. Typically, cleat members may be configured for football, soccer, baseball or any type of activity that requires traction. In one embodiment, outer member 200 can include plurality of mounting portions 230 for receiving plurality of cleat members 240.

Generally, plurality of mounting portions 230 can be disposed on any portions of outer member 200. In some cases, plurality of mounting portions 230 could be disposed on forefoot portion 10 of outer member 200. In other cases, plurality of mounting portions 230 could be disposed on heel portion 14 of outer member 200. In still other cases, plurality of mounting portions 230 could be disposed on midfoot portion 12 of outer member 200. In an exemplary embodiment, plurality of mounting portions 230 may be disposed on forefoot portion 10 and heel portion 14 of outer member 200 for providing increased traction at a forefoot and heel of an article of footwear.

In the current embodiment, plurality of mounting portions 230 may comprise first mounting portion 231 and second mounting portion 232 disposed on first flange covering portion 221 and second flange covering portion 222, respectively. In one embodiment, first mounting portion 231 and second mounting portion 232 may be raised mounting portions for receiving substantially rounded stud-like cleat members. For example, in the current embodiment, first mounting portion 231 and second mounting portion 232 may be configured to receive first cleat member 241 and second cleat member 242. In some cases, first cleat member 241 and second cleat member 242 may have substantially rounded stud-like geometries. In other cases, however, first cleat member 241 and second cleat member 242 could be any other types of cleats having any other sizes and/or geometries.

Plurality of mounting portions 230 may also include third mounting portion 233, fourth mounting portion 234, fifth mounting portion 235, sixth mounting portion 236 and seventh mount portion 237 for receiving third cleat member 243, fourth cleat member 244, fifth cleat member 245, sixth cleat member 246 and seventh cleat member 247, respectively, which are collectively referred to as cleat set 248. In the current embodiment, cleat set 248 comprises cleats that have generally elongated ridge-like shapes in contrast to the substantially rounded shapes of first cleat member 241 and second cleat member 242. In other embodiments, however, cleat members of cleat set 248 may have be any other type of cleats having any other sizes and/or geometries.

In some cases, cleat members comprising plurality of cleat members 240 may be detachable cleat members. For example, in some cases, plurality of cleat members 240 could be snapped into plurality of mounting portions 230. In other cases, however, plurality of cleat members 240 may be substantially permanently attached to plurality of mounting portions 230 using adhesives or fasteners of some kind.

Using the arrangement discussed above, first cleat member 241 may be indirectly attached to first flange portion 141 by way of first flange covering portion 221. In a similar manner, second cleat member 242 may be indirectly attached to second flange portion 142 by way of second flange covering portion 222. With this arrangement, first cleat member 241 may be configured to move with first flange portion 141 as first flange portion 141 undergoes bending or any other type of deformation. Likewise, second cleat member 242 may be configured to move with second flange portion 142 as second flange portion 142 undergoes bending or any other type of deformation. With this arrangement, first cleat member 241 and second cleat member 242 can be configured to move somewhat independently from the rest of plurality of cleat members 240 to maintain contact with a ground surface in various situations.

It will be understood that any type of cleat members could be used with sole structure 100. In some cases, plurality of cleat members 240 could comprise cleat members configured to engage a soft ground surface. For example, in one embodiment, plurality of cleat members 240 could be configured to engage a soft grass surface. In other cases, plurality of cleat members 240 could be configured to engage a hard surface. For example, in one embodiment, plurality of cleat members 240 could be configured to engage a hard grass or artificial turf. In still other embodiments, any other types of cleat members could be used.

Although the current embodiment includes cleat members that are mounted to portions of an outer member, in other embodiments cleat members could be mounted directly to a reinforcing plate. In another embodiment, one or more cleat members could be mounted directly to a flange portion of a reinforcing plate. For example, in another embodiment, a sole structure may not include an outer member. In this alternative embodiment, cleat members may be attached directly to a reinforcing plate, including flange portions of the reinforcing plate.

For purposes of convenience, first flange portion 141 and first flange covering portion 221 may be referred to collectively as first flange assembly 251 throughout the remainder of this detailed description and in the claims. Likewise, second flange portion 142 and second flange covering portion 222 may be referred to collectively as second flange assembly 252. In addition, the terms "upwards" and "downwards" are used throughout the remainder of this detailed description to refer to modes of vertical bending and/or deflection. In particular, the term "upwards" refers to the vertical deflection of a flange portion towards an upper of an article of footwear, while the term "downwards" refers to vertical deflection of a flange portion towards a ground surface.

Figure 3:
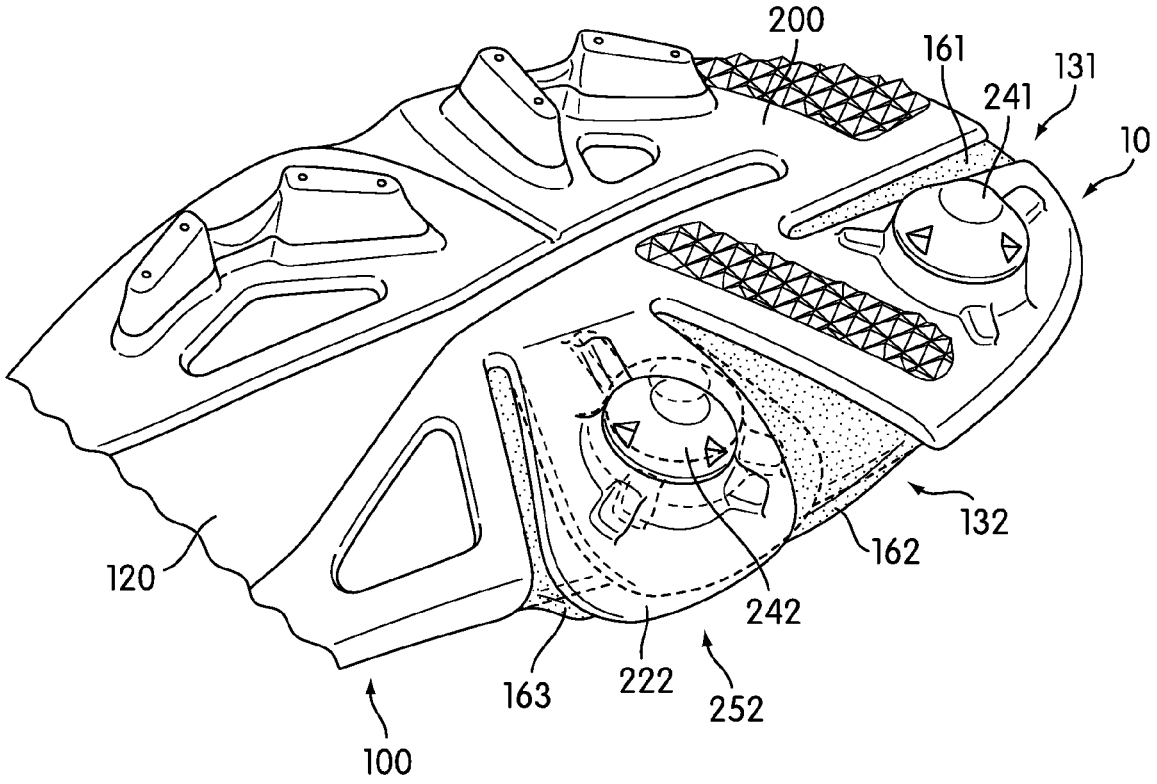
FIG. 3 is an enlarged isometric view of an embodiment of a forefoot portion of a sole structure showing a flange portion associated with a ball of a foot undergoing bending.
Figure 4:
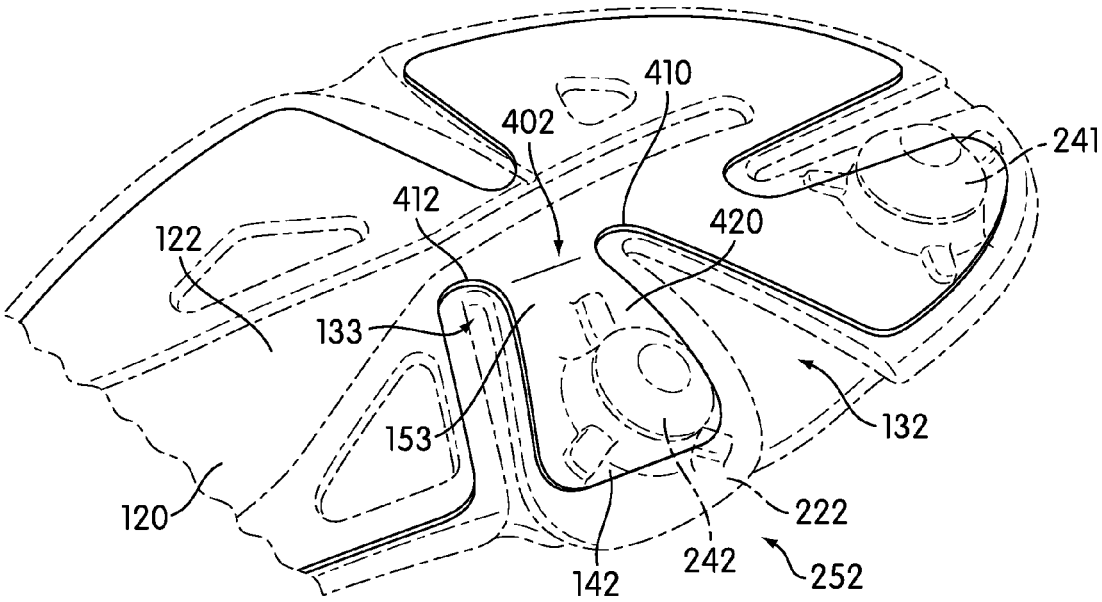
FIG. 4 is an enlarged isometric view of an embodiment of a forefoot portion of a sole structure showing a flange portion associated with a ball of a foot undergoing bending.
Figure 5:
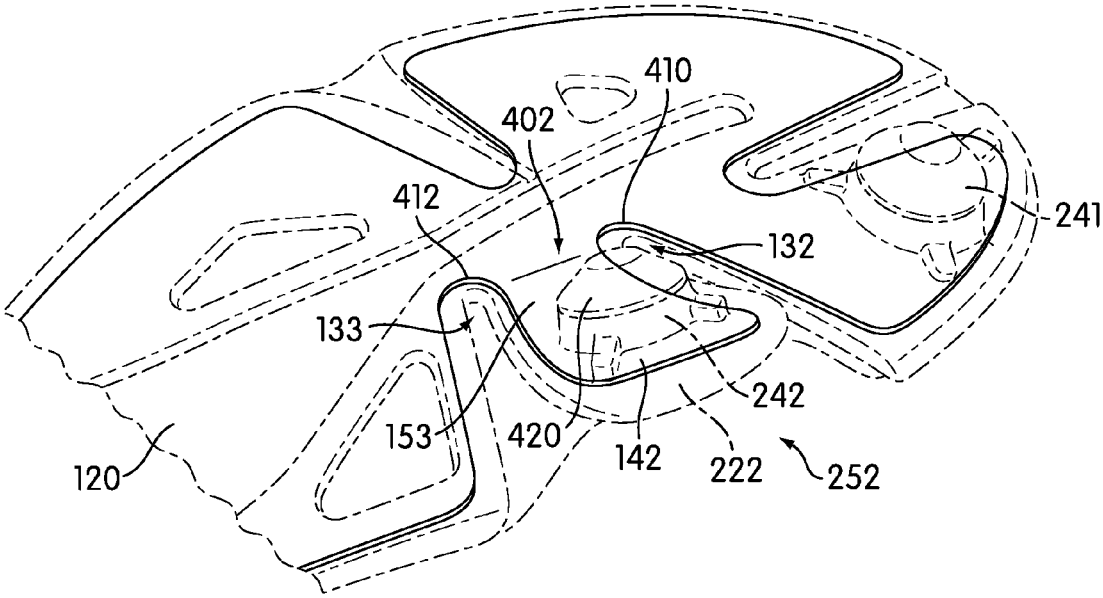
FIG. 5 is an enlarged isometric view of an embodiment of a forefoot portion of a sole structure showing a flange portion associated with a ball of a foot undergoing bending.

FIGS. 3 through 5 illustrate isometric views of an embodiment of second flange assembly 252 undergoing bending. In particular, FIGS. 3 through 5 illustrate views of second flange portion 142 and second flange covering portion 222 undergoing bending with respect to forefoot portion 10 of reinforcing plate 120. For purposes of clarity, outer member 200 is shown in phantom in FIGS. 4 and 5 to indicate the configuration of reinforcing plate 120 during bending.

Referring to FIG. 3, second flange assembly 252 may bend upwards under an applied force. As second flange assembly 252 bends upwards, second cleat member 242, which is mounted to second flange assembly 252, is moved upwards. In other words, second cleat member 242 is displaced upwardly in the vertical direction and has a higher vertical position than first cleat member 241. In addition, as second flange assembly 252 bends upwards, second filling portion 162 and third filling portion 163 undergo some stretching to accommodate the increased widening of second flex groove 132 and third flex groove 133.

Referring now to FIGS. 4 and 5, second flange portion 142 may bend at bending region 402 that is disposed adjacent to central portion 122 of reinforcing plate 120. In particular, bending region 402 is a region generally connecting narrow end 410 of second flex groove 132 and narrow end 412 of third flex groove 133 that are disposed adjacent to first end portion 153 of second flange portion 142. As seen in FIG. 4, an upward force applied to lower surface 420 of second flange portion 142 works to bend second flange portion 142 upwardly about bending region 402. In some cases, an upward force could be transferred to lower surface 420 by way of second cleat member 242 and second flange covering portion 222. Likewise, as seen in FIG. 5, a downward force applied to an upper surface (disposed opposite of lower surface 420) of second flange portion 142 works to bend second flange portion 142 downwardly about bending region 402. In some cases, a downward force could be transferred to the upper surface of flange portion 142 by a ball portion of a foot. With this arrangement, second flange portion 142 can be configured to bend to accommodate different forces, which can help maintain second cleat member 242 in an engaged position with a ground surface.

Figure 6:
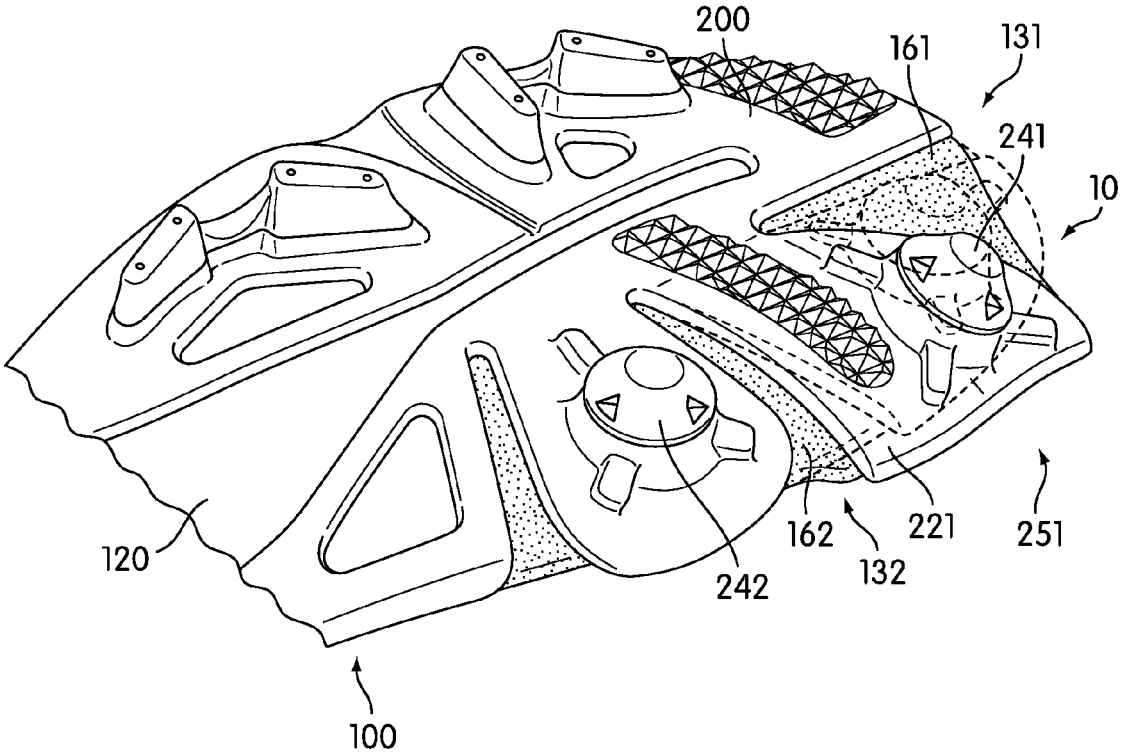
FIG. 6 is an enlarged isometric view of an embodiment of a forefoot portion of a sole structure showing a flange portion associated with a big toe of a foot undergoing bending.
Figure 7:
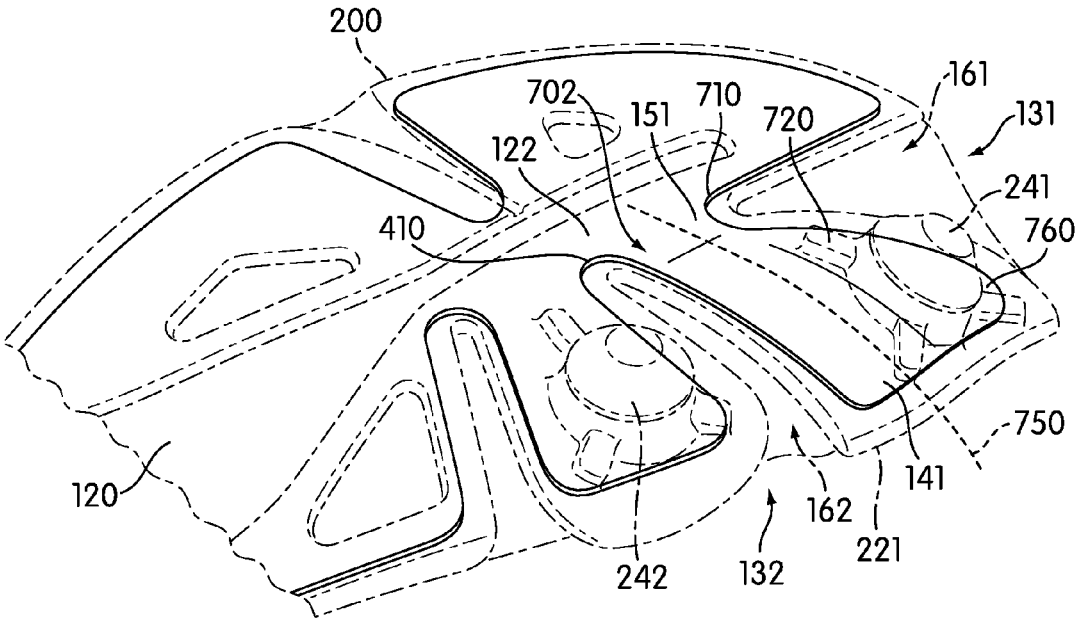
FIG. 7 is an enlarged isometric view of an embodiment of a forefoot portion of a sole structure showing a flange portion associated with a big toe of a foot undergoing bending.
Figure 8:
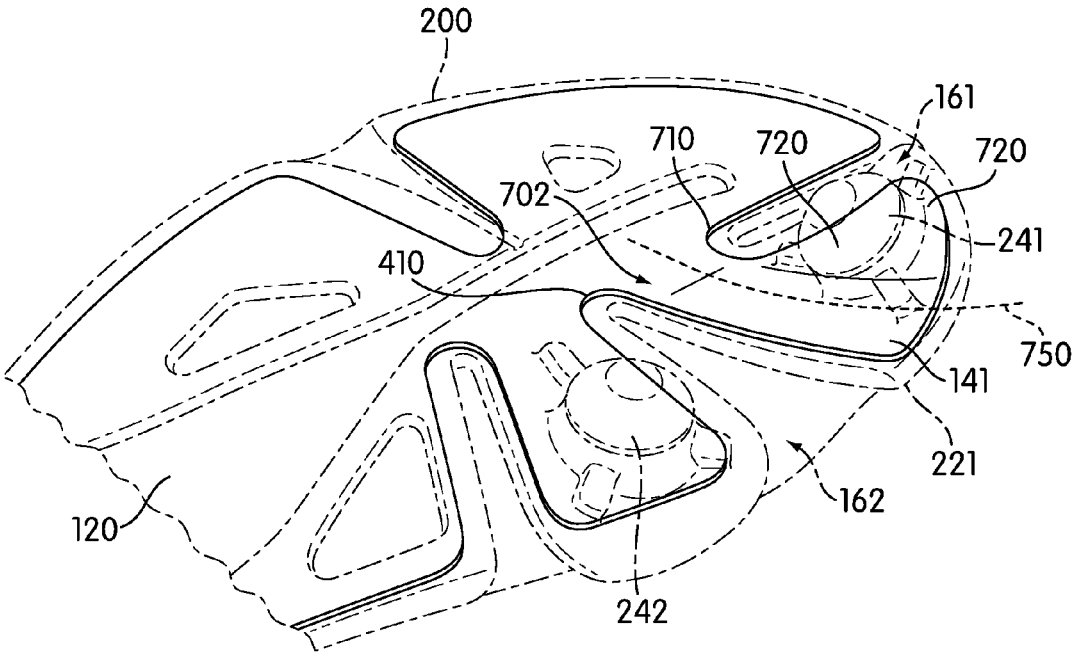
FIG. 8 is an enlarged isometric view of an embodiment of a forefoot portion of a sole structure showing a flange portion associated with a big toe of a foot undergoing bending.

FIGS. 6 through 8 illustrate isometric views of an embodiment of first flange assembly 251 undergoing bending. In particular, FIGS. 6 through 8 illustrate views of first flange portion 141 and first flange covering portion 221 undergoing bending with respect to forefoot portion 10 of sole structure 100. For purposes of clarity, outer member 200 is shown in phantom in FIGS. 7 and 8 to indicate the configuration of reinforcing plate 120 during bending.

Referring to FIG. 6, first flange assembly 251 may bend upwards under an applied force. As first flange assembly 251 bends upwards, first cleat member 241, which is mounted to first flange assembly 251, is moved upwards. In other words, first cleat member 241 is displaced upwardly in the vertical direction and has a higher vertical position than second cleat member 242. In addition, as first flange assembly 251 bends upwards, first filling portion 161 and second filling portion 162 undergo some stretching to accommodate the widening of first flex groove 131 and second flex groove 132.

Referring now to FIGS. 7 and 8, first flange portion 141 may bend at bending region 702 that is disposed adjacent to central portion 122 of reinforcing plate 120. In particular, bending region 702 is a region generally connecting narrow end 710 of first flex groove 131 and narrow end 410 of second flex groove 132, which are disposed adjacent to first end portion 151 of first flange portion 141. As seen in FIG. 7, an upward force applied to lower surface 720 of first flange portion 141 works to bend first flange portion 141 upwardly about bending region 702. In some cases, an upward force could be transferred to lower surface 720 by way of first cleat member 241 and first flange covering portion 221. Likewise, as seen in FIG. 8, a downward force applied to an upper surface (disposed opposite of lower surface 720) of first flange portion 141 works to bend first flange portion 141 downwardly about bending region 702. In some cases, a downward force could be transferred to the upper surface of first flange portion 141 by a big toe of a foot. With this arrangement, first flange portion 141 can be configured to bend to accommodate different forces, which can help maintain first cleat member 241 in an engaged position with a ground surface.

Figure 9:
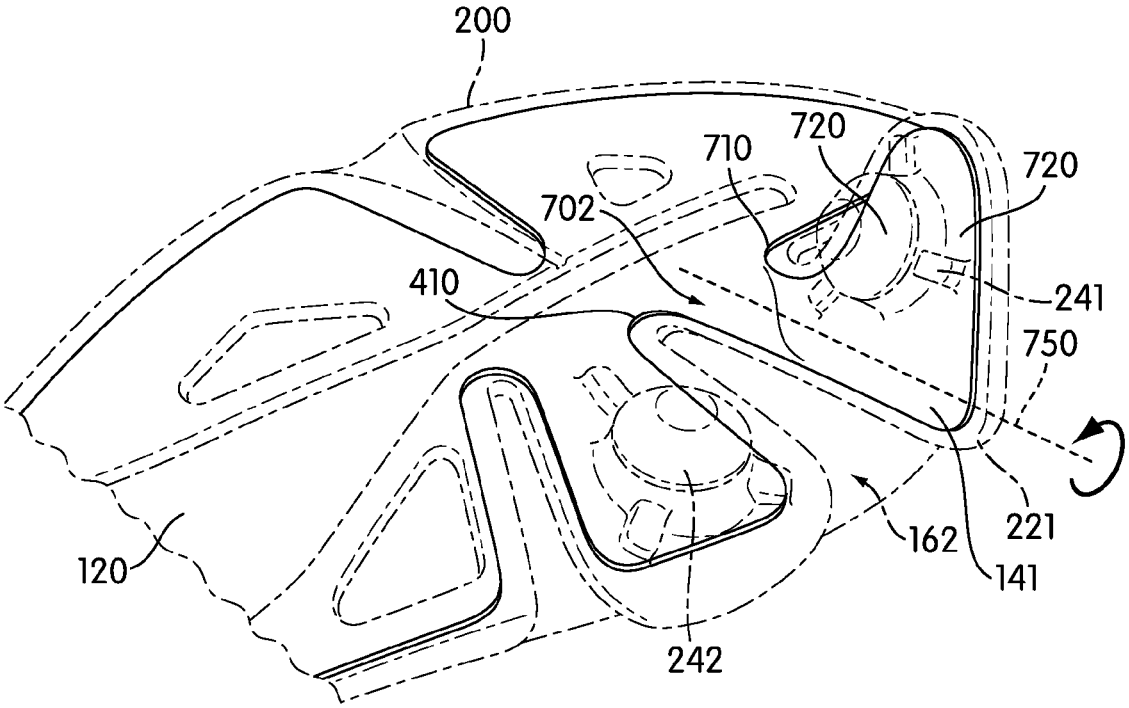
FIG. 9 is an enlarged isometric view of an embodiment of a forefoot portion of a sole structure showing a flange portion undergoing twisting.

A sole structure can include provisions for producing twisting as well as bending in a flange portion. In some embodiments, first cleat member 241 may be spaced apart from a normal bending axis of first flange portion 141. In the current embodiment, first flange portion 141 may be associated with normal bending axis 750 that extends in a substantially perpendicular direction from bending region 702. The term "normal bending axis" refers to the axis about which normal bending may occur such that the bending forces through bending region 702 are substantially equal and no torsion or twisting occurs at bending region 702. In an exemplary embodiment, first cleat member 241 may be associated with extend portion 760 of first flange portion 141 that is spaced apart from normal bending axis 750. With this arrangement, forces applied to first flange portion 141 by first cleat member 241 may result in a combination of bending and twisting at bending region 702, which may cause rotation of first flange portion 141 about normal bending axis 750 of first flange portion 141, as well as vertical deflection. This configuration may allow first flange portion 141 to deflect in a forward and lateral direction, simultaneously, which may accommodate a wider range of motions of the big toe. Additionally, as illustrated in FIG. 9, in some cases first flange portion 141 may undergo twisting without any bending. In other words, in some cases, flange portion 141 could rotate about normal bending axis 750 to accommodate various forces applied to first cleat member 241.

By providing flange portions including cleat members that can bend and/or twist, a sole structure can be configured to provide increased ground contact on irregular ground surfaces. In particular, flange portions associated with the ball of the foot and the big toe can deflect in a manner that accommodates the natural motion of the foot to while providing substantially consistent ground contact.

Figure 10:
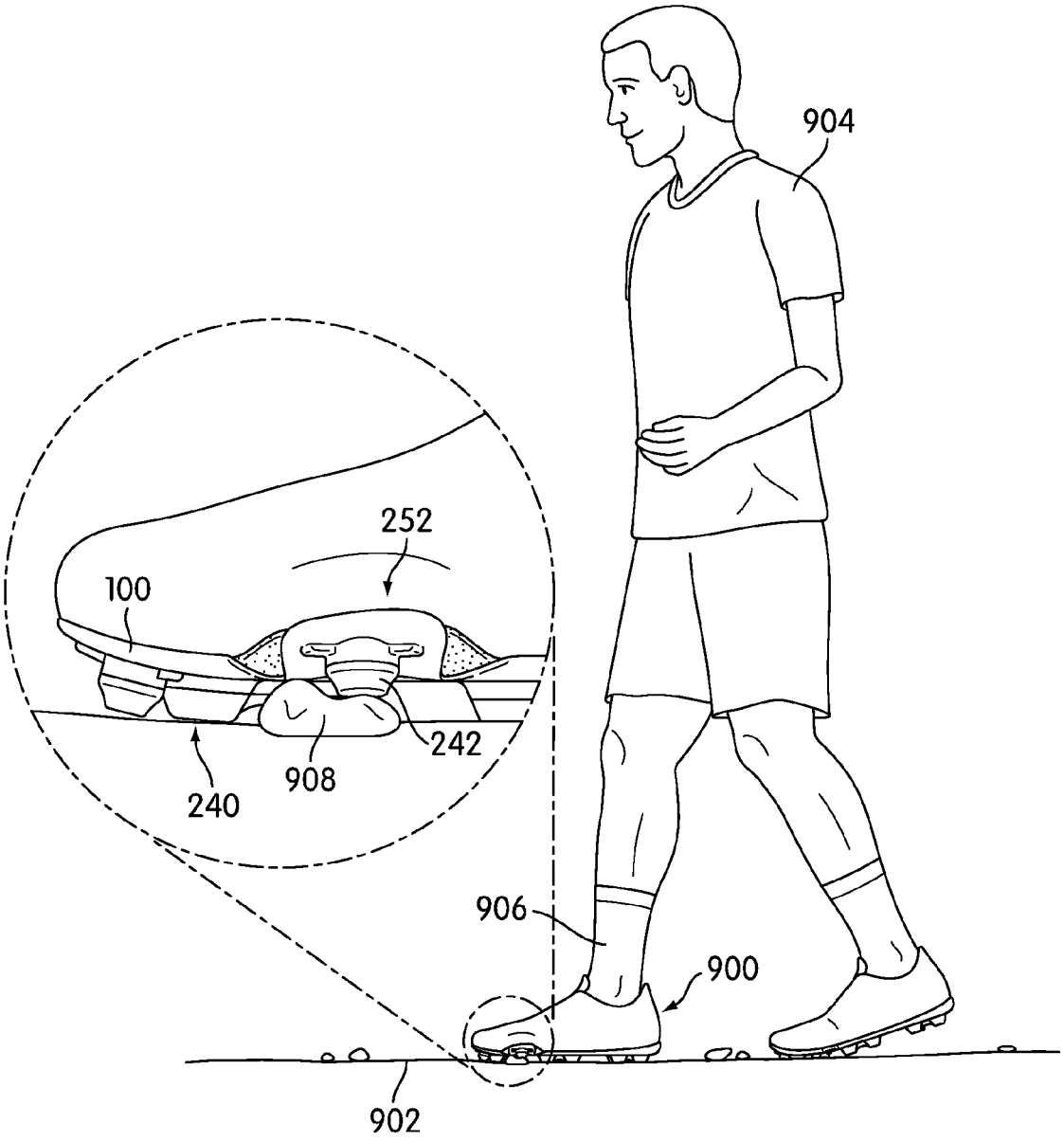
FIG. 10 is a schematic view of an embodiment of an athlete wearing an article of footwear incorporating a sole structure with flexible flange portions.
Figure 11:
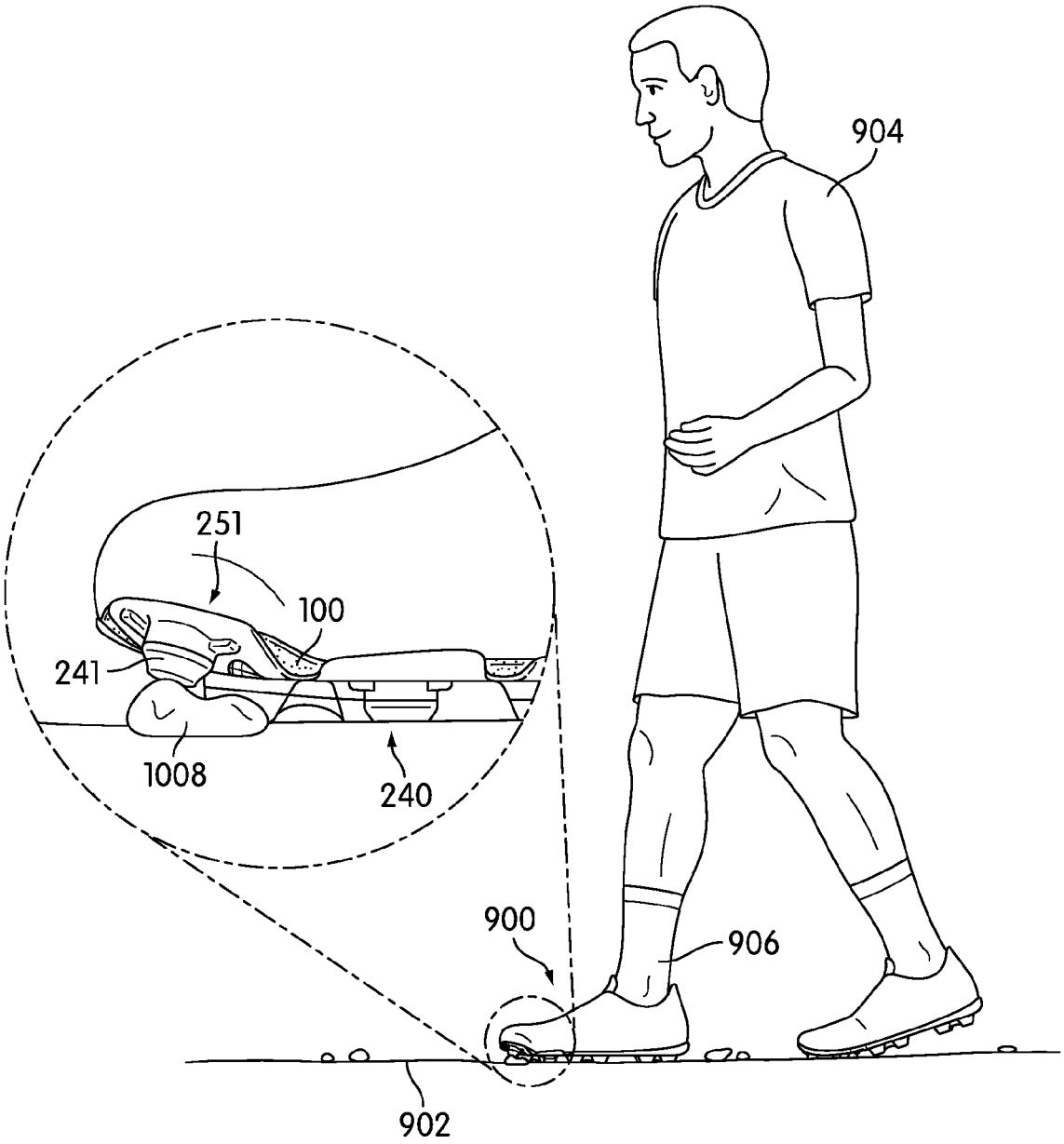
FIG. 11 is a schematic view of an embodiment of an athlete wearing an article of footwear incorporating a sole structure with flexible flange portions.

FIGS. 10 and 11 illustrate embodiments of sole structure 100 incorporated into article of footwear 900. Referring to FIG. 10, sole structure 100 adapts to the uneven ground surface 902 as athlete 904 steps down with foot 906. In this case, rock 908 is disposed beneath a ball region of foot 906. Second flange assembly 252 deflects upwardly to allow the remaining cleat members of plurality of cleat members 240 to maintain consistent ground contact. In particular, second cleat member 242 engages rock 908, while plurality of cleat members 240 remain engaged with ground surface 902. This helps athlete 904 maintain good balance and provides consistent traction.

Referring to FIG. 11, as athlete 904 continues running, sole structure 100 continues to adapt to uneven ground surface 902 to provide consistent traction. At this point, rock 1008 is disposed beneath a big toe of foot 906. First flange assembly 251 deflects upwardly to allow the remaining cleat members of plurality of cleat members 240 to maintain consistent ground contact. In particular, first cleat member 241 engages rock 1008, while plurality of cleat members 240 remain engaged with uneven ground surface 902. This helps athlete 904 maintain good balance and provides consistent traction.

An article can include provisions for modifying the flexibility of various flange portions. In some cases, two or more flange portions can be made of substantially different materials. In other cases, two or more flange portions can have substantially different geometries. In still other cases, the flexibility of various flange portions could be varied in any other manner.

Figure 12:
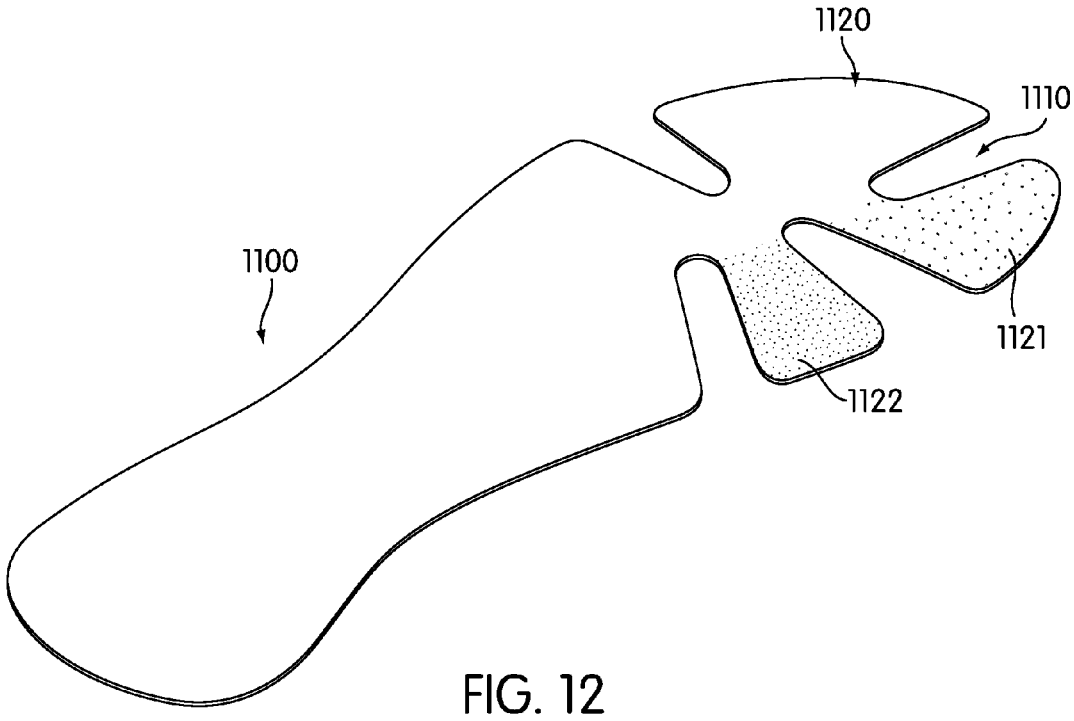
FIG. 12 is an isometric view of an embodiment of a reinforcing plate.

FIG. 12 illustrates an embodiment of reinforcing plate 1100 that may be used with a sole structure. Reinforcing plate 1100 may be substantially similar to reinforcing plate 120 of the previous embodiment in many respects. For example, reinforcing plate 1100 may include plurality of flex grooves 1110 and plurality of flange portions 1120. In this case, plurality of flange portions 1120 also includes first flange portion 1121 and second flange portion 1122, corresponding to a big toe of a foot and a ball portion of a foot, respectively.

In some embodiments, first flange portion 1121 and second flange portion 1122 may be made of substantially different materials. In the current embodiment, first flange portion 1121 comprises a first material and second flange portion 1122 comprises a second material, indicated schematically in FIG. 12 using different types of shading. In an exemplary embodiment, the first material may be substantially different from the second material. Furthermore, the first material may have a first rigidity that is substantially different from the second rigidity. In one embodiment, the first rigidity may be substantially greater than the second rigidity. For example, in some cases, the first material may be a carbon fiber composite material, while the second material could be a polymer that is not reinforced with fibers. In another embodiment, the first rigidity may be substantially less than the second rigidity.

Although the current embodiment illustrates first flange portion 1121 and second flange portion 1122 comprising different materials having different rigidities, other embodiments could include more than two flange portions having different rigidities. For example, in another embodiment, three or more flange portions of reinforcing plate 1100 could comprise three distinct materials, each having a substantially different rigidity. Moreover, in some cases, the flange portions could have substantially similar material properties as the reinforcing plate, while in other cases the flange portions could have substantially different material properties from the reinforcing plate.

Figure 13:
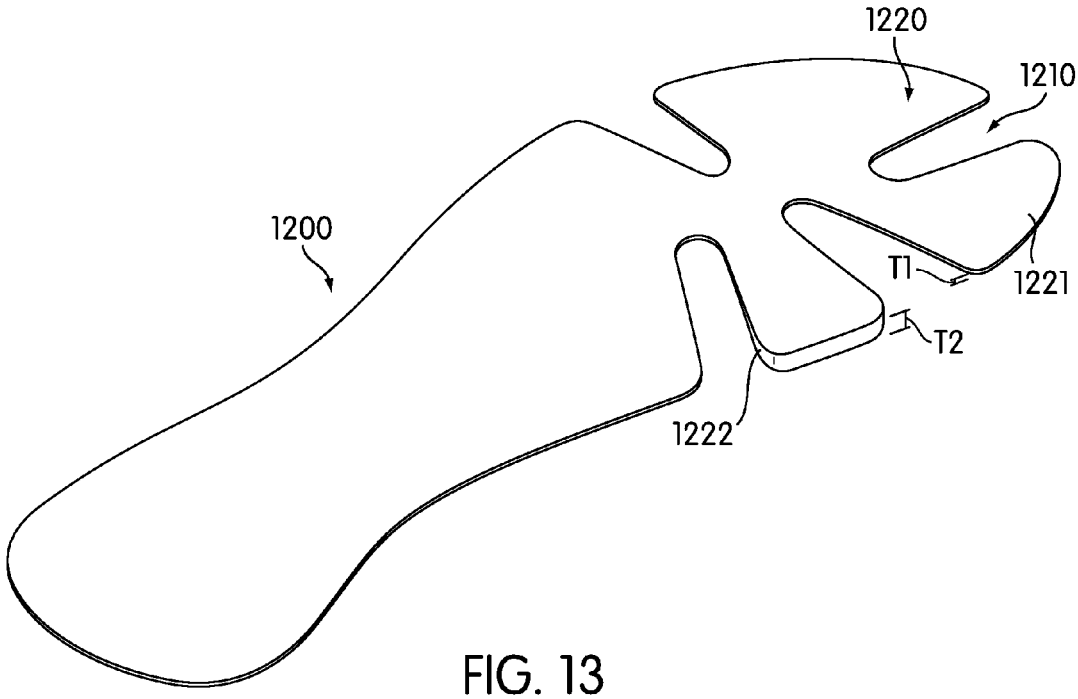
FIG. 13 is an isometric view of an embodiment of a reinforcing plate.

FIG. 13 illustrates an embodiment of reinforcing plate 1200 that may be used with a sole structure. Reinforcing plate 1200 may be substantially similar to reinforcing plate 120 of the previous embodiment in many respects. For example, reinforcing plate 1200 may include plurality of flex grooves 1210 and plurality of flange portions 1220. In this case, plurality of flange portions 1220 also includes first flange portion 1221 and second flange portion 1222, corresponding to a big toe of a foot and a ball portion of a foot, respectively.

Generally, the thicknesses of two of more flange portions can vary. In the current embodiment, first flange portion 1221 is associated with a first thickness T1 and second flange portion 1222 is associated with a second thickness T2. In an exemplary embodiment, first thickness T1 may be substantially different from second thickness T2. In some embodiments, first thickness T1 could be substantially smaller than second thickness T2. For example, in some cases, first thickness T1 could be approximately 2 mm, while second thickness T2 could be approximately 4 mm. In another embodiment, first thickness T1 could be substantially greater than second thickness T2. By using different thicknesses for first flange portion 1221 and second flange portion 1222, the amount of bending of each flange portion can be varied. For example, in the current embodiment, first flange portion 1221 may undergo a greater amount of bending than second flange portion 1222 since first flange portion 1221 is substantially thinner than second flange portion 1222 and provides less resistance to bending forces.

Although the current embodiment illustrates two flange portions having substantially different thicknesses, in other embodiments more than two flange portions could have substantially different thicknesses. Moreover, in other embodiments the geometries of two or more flange portions could be varied to accomplish different amounts of bending.

Figure 14:
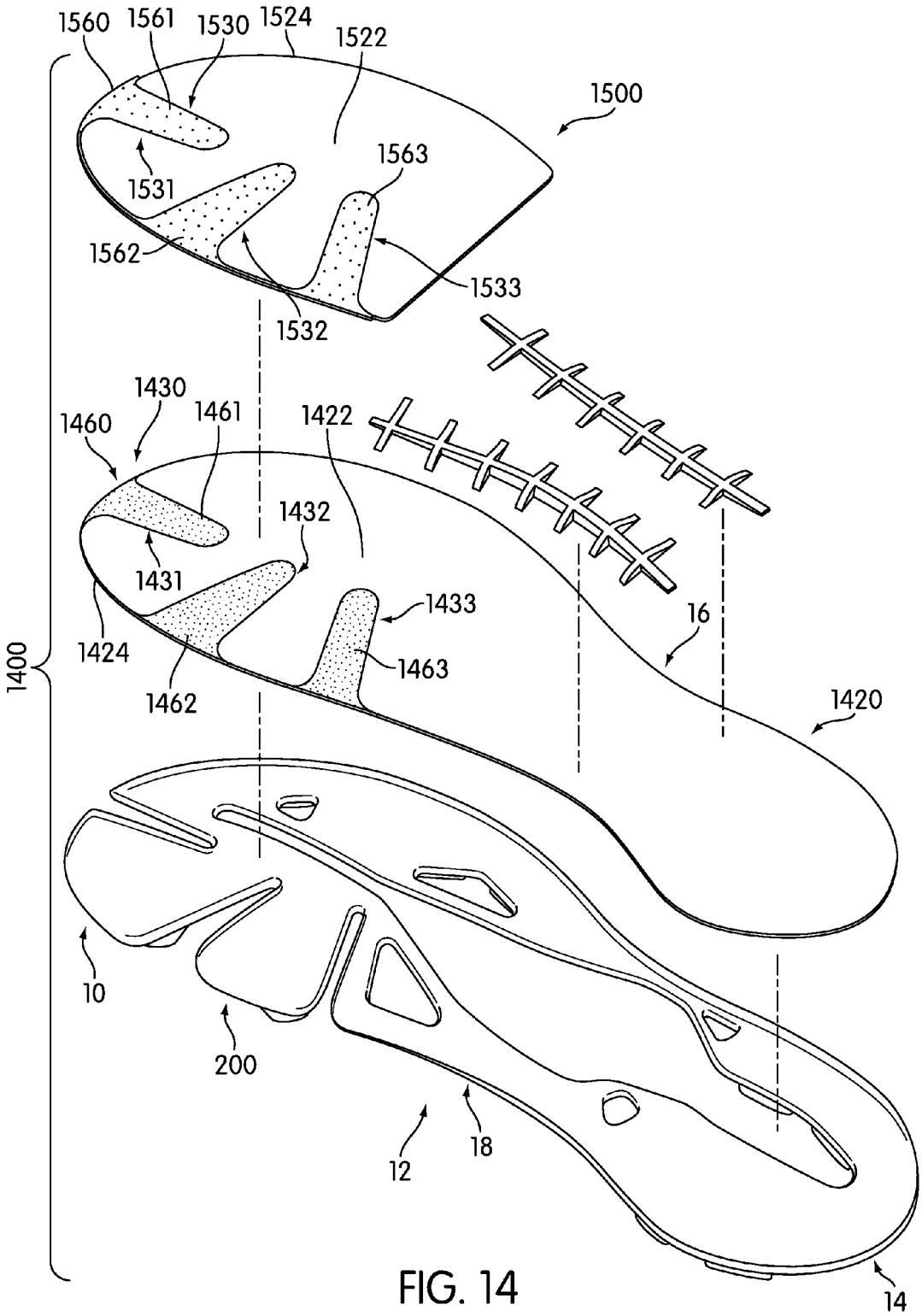
FIG. 14 is an isometric exploded view of an embodiment of a sole structure and a lasting board.

FIG. 14 illustrates another embodiment of sole structure 1400. Sole structure 1400 may be substantially similar in many respects to sole structure 100 of the previous embodiment. Sole structure 1400 generally includes forefoot portion 10, midfoot portion 12 and heel portion 14 as well as lateral side 16 and medial side 18. Sole structure 1400 further includes outer member 200 and a plurality of cleat members (not shown). Numerals from the first embodiment are used identically in this embodiment to describe the same features.

Sole structure 1400 includes reinforcing plate 1420. Reinforcing plate 1420 may be substantially similar to reinforcing plate 120 of the previous embodiment. However, in contrast to the previous embodiment, reinforcing plate 1420 has only three flex grooves. In particular, reinforcing plate 1420 comprises plurality of flex grooves 1430 including first flex groove 1431, second flex groove 1432 and third flex groove 1433. First flex groove 1431, second flex groove 1432 and third flex groove 1433 generally extend from central portion 1422 to peripheral portion 1424 of reinforcing plate 1420.

Plurality of flex grooves 1430 may be further associated with plurality of filling portions 1460. Plurality of filling portions 1460 comprise first filling portion 1461, second filling portion 1462 and third filling portion 1463 associated with first flex groove 1431, second flex groove 1432 and third flex groove 1433, respectively. Furthermore, plurality of filling portions 1460 may be made of a substantially flexible material that facilitates the flexing of plurality of flex grooves 1420. This arrangement may be substantially similar to the arrangement described in the previous embodiment for filling member 160 and plurality of flex grooves 130.

An article of footwear can be configured with one or more lasting components that are configured to facilitate flexibility in a sole structure. In some embodiments, an article of footwear could include provisions to facilitate flexibility in a reinforcing plate. In an exemplary embodiment, an article of footwear could be configured with a lasting board that facilitates flexibility in a reinforcing plate.

In one embodiment, sole structure 1400 may be associated with lasting board 1500. In the current embodiment, lasting board 1500 may be associated with forefoot portion 10 of sole structure 1400. In other words, lasting board 1500 may not be a full length lasting board. In other embodiments, however, a full length lasting board could be used.

Lasting board 1500 may be attached to an upper (not shown). In some cases, lasting board 1500 may be used to create a substantially smooth toe area for an upper by providing a relatively rigid attachment surface. In other cases, lasting board 1500 can be used in any other manner.

In some embodiments, a lasting board can include one or more flex grooves. In the current embodiment, lasting board 1500 may include plurality of flex grooves 1530. Plurality of flex grooves 1530 can include first flex groove 1531, second flex groove 1532 and third flex groove 1533. Each flex groove of plurality of flex grooves 1530 may generally extend from central portion 1522 of lasting board 1500 to peripheral portion 1524 of lasting board 1500. Moreover, the orientation of each flex groove of plurality of flex grooves 1530 may be substantially similar to the orientations of the corresponding flex grooves of reinforcing plate 1420. In other words, first flex groove 1531, second flex groove 1532 and third flex groove 1533 of lasting board 1500 may be arranged in a substantially similar configuration to first flex groove 1431, second flex groove 1432 and third flex groove 1433, respectively, of reinforcing plate 1420. Moreover, plurality of flex grooves 1530 may be filled with filling portions of filling member 1560. In this case, filling member 1560 may comprise first filling portion 1561, second filling portion 1562 and third filling portion 1563 that are configured to extend throughout first flex groove 1531, second flex groove 1532 and third flex groove 1533, respectively. With this arrangement, first filling portion 1561, second filling portion 1562 and third filling portion 1563 may facilitate flexibility of first flex groove 1531, second flex groove 1532 and third flex groove 1533, respectively, of lasting board 1500. This arrangement may help lasting board 1500 to flex in a substantially similar manner to reinforcing plate 1420 to maximize flexibility for sole structure 1400.

In some embodiments, filling member 1560 may comprise a substantially softer material than lasting board 1500. In some cases, filling member 1560 may have a durometer of 70 A. In addition, in some cases, lasting board 1500 may have a durometer of 65 D. In other cases, however, filling member 1560 and lasting board 1500 could have any other durometer values. Furthermore, in still other cases, filling member 1560 and lasting board 1500 could have substantially similar durometer values.

Although the current embodiment illustrates a lasting board configured to extend throughout a forefoot portion of an article, in other embodiments the size and/or geometry of a lasting board could be varied. For example, in another embodiment, a toe board could be used that only extends throughout the toe portion of an article. In still other embodiments, other shapes and sizes could be used for a lasting board. Additionally, in some cases, a lasting board can be used with a strobel material. For example, in one embodiment, a lasting board can be used for the forefoot of an article and a strobel material can be used for the midfoot and heel portions of the article.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A sole structure for an article of footwear, comprising:

a reinforcing plate;

the reinforcing plate including a flange portion, the flange portion having a first end portion connected to a central portion of the reinforcing plate and a second end portion extending to an outer peripheral portion of the reinforcing plate;

wherein the flange portion is formed by a first flex groove and a second flex groove defined by the reinforcing plate;

wherein the first flex groove extends from a first flex groove first end at the central portion in an approximately longitudinal direction toward a first flex groove second end at a forward edge of the reinforcing plate and the second flex groove extends from a second flex groove first end at the central portion in an approximately lateral direction toward a second flex groove second end at a medial side of the reinforcing plate;

wherein the first flex groove first end is separated from the second flex groove first end at the central portion to define the first end portion of the flange portion and a bending region disposed adjacent to the central portion of the reinforcing plate;

wherein the flange portion is narrower at the first end portion and widens toward the second end portion;

a cleat member associated with the flange portion; and wherein the flange portion corresponds to a big toe of a foot and wherein the flange portion is capable of bending with the big toe at the bending region.

2. The sole structure according to claim 1, wherein the sole structure includes an outer member associated with a lower surface of the reinforcing plate and wherein the outer member includes a flange covering portion that is configured to cover the flange portion.

3. The sole structure according to claim 2, wherein the cleat member is mounted to the flange covering portion.

4. The sole structure according to claim 2, wherein the reinforcing plate is substantially more rigid than the outer member.

5. The sole structure according to claim 1, wherein the flange portion is associated with a normal bending axis that extends in a direction substantially perpendicular to the bending region, and wherein the cleat member is disposed on an extend portion of the flange portion that is spaced apart from the normal bending axis, such that forces applied to the flange portion by the cleat member result in a combination of bending and twisting at the bending region.

6. The sole structure according to claim 1, wherein the first flex groove corresponds to the gap between the big toe and an index toe.

7. The sole structure according to claim 1, wherein the second flex groove corresponds to an interphalangeal joint of the big toe.

8. A sole structure for an article of footwear, comprising:

a reinforcing plate;

the reinforcing plate including a flange portion, the flange portion having a first end portion connected to a central portion of the reinforcing plate and a second end portion extending to an outer peripheral portion of the reinforcing plate;

the flange portion being disposed between a first flex groove and a second flex groove defined by the reinforcing plate;

a first flex groove first end being disposed adjacent to the first end portion of the flange portion and a second flex groove first end being disposed adjacent to the first end portion of the flange portion;

wherein the first flex groove extends from the first flex groove first end at the central portion in an approximately longitudinal direction toward a first flex groove second end at a forward edge of the reinforcing plate and the second flex groove extends from the second flex groove first end at the central portion in an approximately lateral direction toward a second flex groove second end at a medial side of the reinforcing plate;

wherein the flange portion is narrower at the first end portion and widens toward the second end portion;

a bending region of the flange portion extending between the first flex groove first end and the second flex groove first end, the flange portion being configured to bend with respect to the reinforcing plate at the bending region;

a normal bending axis extending perpendicularly from the bending region through the flange portion;

a cleat member associated with the flange portion; and wherein the cleat member is spaced apart from the normal bending axis.

9. The sole structure according to claim 8, wherein the flange portion undergoes twisting when a force is applied to the cleat member.

10. The sole structure according to claim 9, wherein the cleat member is capable of rotating about the normal bending axis.

11. The sole structure according to claim 8, wherein the flange portion corresponds to a big toe of a foot.

12. The sole structure according to claim 8, wherein a first filling portion extends through the first flex groove and wherein a second filling portion extends through the second flex groove.

13. The sole structure according to claim 12, wherein the first filling portion and the second filling portion are configured to stretch when the flange portion bends.

14. A sole structure for an article of footwear, comprising:

a reinforcing plate;

a plurality of flex grooves disposed in a forefoot portion of the reinforcing plate;

the plurality of flex grooves extending from a central portion of the reinforcing plate to an outer peripheral portion of the reinforcing plate;

the plurality of flex grooves forming a first flange portion and a second flange portion;

the first flange portion being associated with a first cleat member and the second flange portion being associated with a second cleat member;

wherein each flex groove of the plurality of flex grooves extends in an approximately radial direction from the central portion;

wherein the first flange portion has a first flange first end portion connected to the central portion of the reinforcing plate and a first flange second end portion extending to an outer peripheral portion of the reinforcing plate;

wherein the first flange portion is formed by a first flex groove and a second flex groove defined by the reinforcing plate;

wherein the first flex groove extends from a first flex groove first end at the central portion in an approximately longitudinal direction toward a first flex groove second end at a forward edge of the reinforcing plate and the second flex groove extends from a second flex groove first end at the central portion in an approximately lateral direction toward a second flex groove second end at a medial side of the reinforcing plate;

wherein the first flex groove first end is separated from the second flex groove first end at the central portion to define the first flange first flange first end portion of the first flange portion and a bending region disposed adjacent to the central portion of the reinforcing plate;

wherein the first flange portion is narrower at the first flange first end portion and widens toward the first flange second end portion; and wherein the first flange portion corresponds to a big toe of a foot and wherein the first flange portion is capable of bending with the big toe at the bending region.

15. The sole structure according to claim 14, wherein the plurality of flex grooves includes four flex grooves.

16. The sole structure according to claim 14, wherein each flex groove is associated with a filling portion.

17. The sole structure according to claim 16, wherein each filling portion is substantially more elastic than the reinforcing plate.

18. The sole structure according to claim 14, wherein the first flex groove increases in width from the first flex groove first end to the first flex groove second end, and the second flex groove increases in width from the second flex groove first end to the second flex groove second end.

19. The sole structure according to claim 14, wherein the second flange portion corresponds to a ball region of a foot.

20. The sole structure according to claim 14, wherein the second flange portion is formed by the second flex groove and a third flex groove defined by the reinforcing plate;

wherein the second flange portion has a second flange first end portion connected to the central portion of the reinforcing plate and a second flange second end portion extending to an outer peripheral portion of the reinforcing plate;

wherein the third flex groove extends from a third flex groove first end at the central portion in an approximately lateral direction toward a third flex groove second end at the medial side of the reinforcing plate;

wherein the second flex groove first end is separated from the third flex groove first end at the central portion to define the first end portion of the second flange portion and a second bending region disposed adjacent to the central portion of the reinforcing plate;

wherein the second flange portion is narrower at the second flange first end portion and widens toward the second flange second end portion; and wherein the second flange portion is configured to bend at the second bending region.

* * * * *